US008847721B2

(12) United States Patent
Cooper et al.

(10) Patent No.: US 8,847,721 B2
(45) Date of Patent: Sep. 30, 2014

(54) THERMALLY CONDUCTIVE COIL AND METHODS AND SYSTEMS

(75) Inventors: Alexander Cooper, Belmont, CA (US); Alton H. Phillips, East Palo Alto, CA (US); Scott Coakley, Belmont, CA (US)

(73) Assignee: Nikon Corporation, Tokyo (JP)

( * ) Notice: Subject to any disclaimer, the term of this patent is extended or adjusted under 35 U.S.C. 154(b) by 1031 days.

(21) Appl. No.: 12/616,907

(22) Filed: Nov. 12, 2009

(65) Prior Publication Data

US 2011/0109419 A1 May 12, 2011

(51) Int. Cl.

| | |
|---|---|
| ***H01F 27/30*** | (2006.01) |
| ***H01F 5/00*** | (2006.01) |
| ***H01F 27/28*** | (2006.01) |
| ***H01F 27/22*** | (2006.01) |
| ***H01F 5/06*** | (2006.01) |
| ***H01F 41/06*** | (2006.01) |

(52) U.S. Cl.

CPC ..... *H01F 5/06* (2013.01); *H01F 27/22* (2013.01); *H01F 41/0658* (2013.01)

USPC ..... 336/206; 326/200; 326/232

(58) Field of Classification Search

USPC ..... 336/206, 200, 232

See application file for complete search history.

(56) References Cited

U.S. PATENT DOCUMENTS

| | | | | |
|---|---|---|---|---|
| 5,959,415 | A | 9/1999 | Sedgewick et al. | |
| 6,114,781 | A | 9/2000 | Hazelton et al. | |
| 6,121,867 | A | 9/2000 | Uda et al. | |
| 6,140,734 | A | 10/2000 | Hazelton et al. | |
| 6,313,550 | B1 | 11/2001 | Binnard et al. | |
| 6,570,273 | B2 | 5/2003 | Hazelton | |
| 6,836,031 | B2 | 12/2004 | Emoto et al. | |
| 7,082,674 | B2 | 8/2006 | Mori et al. | |
| 2002/0036561 | A1 * | 3/2002 | Jedlitschka | 336/232 |
| 2002/0145500 | A1 * | 10/2002 | Razzell et al. | 336/232 |
| 2003/0080631 | A1 | 5/2003 | Kageyama et al. | |
| 2005/0236915 | A1 | 10/2005 | Phillips | |
| 2007/0268475 | A1 | 11/2007 | Binnard | |
| 2008/0165451 | A1 | 7/2008 | Binnard et al. | |
| 2008/0252151 | A1 | 10/2008 | Binnard et al. | |

FOREIGN PATENT DOCUMENTS

FR 2784261 A1 * 4/2000

* cited by examiner

*Primary Examiner* — Tsz Chan

(74) *Attorney, Agent, or Firm* — Roeder & Broder LLP

(57) ABSTRACT

Embodiments of the invention provide improved thermal conductivity within, among other things, electromagnetic coils, coil assemblies, electric motors, and lithography devices. In one embodiment, a thermally conductive coil includes at least two adjacent coil layers. The coil layers include windings of wires formed from a conductor and an insulator that electrically insulates the windings within each coil layer. In some cases the insulator of the wires is at least partially absent along an outer surface of one or both coil layers to increase the thermal conductivity between the coil layers. In some embodiments, an insulation layer is provided between the coil layers to electrically insulate the coil layers. In some cases the insulation layer has a thermal conductivity greater than the thermal conductivity of the wire insulator.

24 Claims, 14 Drawing Sheets

THERMALLY CONDUCTIVE COIL AND METHODS AND SYSTEMS

BACKGROUND

Electromagnetic coils are useful for generating and measuring magnetic fields in a variety of settings. Such coils can be incorporated into a wide array of devices and systems including, for example, inductors, transformers, electric motors, and larger systems that incorporate such components. As just one example, the electromagnetic coils in an electric motor can enable it to precisely position a semiconductor wafer during photolithography and other semiconductor processing. Alternately, coils and electric motors are used in many other devices including, for example, elevators, electric razors, machine tools, metal cutting machines, inspection machines and disk drives.

An electromagnetic coil is generally formed from a wire wound multiple times around a core or form. The wire usually includes a conductor within an insulative coating or jacket that electrically isolates consecutive windings or "turns" of the conductor. As an electric current is passed through the conductor, the windings generate a magnetic field that can be used to, for example, generate movement within an electric motor. Conversely, when the coil is placed within an external magnetic field, the windings generate an electric current corresponding to the rate of change of the external field.

In addition to desired effects, a coil can generate heat due to the inherent resistance that currents encounter within the coil windings. Excessive heat can damage the coil or components within its surrounding environment and as such, effectively limits the amount of power that can be applied to the coil. Short of irreversible damage, undesired heat can also affect the performance of a coil or the device incorporating the coil. For example, excessive heating of the coils of an electric motor can increase the resistance of the coils, exacerbating the heat problem and reducing the performance of the motor. In addition, heat can cause the thermal expansion of machine components, resulting in inaccuracy of precision mechanical systems.

Systems for mitigating heat generation within a coil include both passive and active cooling systems. For example, heat sinks draw thermal energy away from the coil and often provide an extended surface area for more effective cooling. In other systems, a fluid flowing past the coil removes heat to cool the coil.

Even with these types of aids, however, there remains a need for improved systems for reducing the effect of excess coil heat. Further improvements in heat mitigation can, for example, allow a higher operating power, more compact or more powerful motors, and/or the use of a greater variety of less heat-resistant materials. In addition, there remains a need for improved heat handling within high precision systems, especially as the degree of required precision increases. For example, linear and planar motors used in machines such as, for example, photolithography devices, must be able to precisely position objects (e.g., a stage for a semiconductor substrate or reticle) at ever-decreasing tolerances, despite excess heat generated by the coils of the motors.

SUMMARY

Embodiments of the invention provide features and techniques for improved thermal conductivity within, among other things, electromagnetic coils, coil assemblies, electric motors, lithography devices and related methods.

According to one aspect of the invention, a thermally conductive electromagnetic coil includes a first coil layer and a second coil layer. The first coil layer includes windings of a first wire formed from a conductor and an insulator that electrically insulates the windings of the conductor within the first coil layer. The windings of the first wire define outer first and second surfaces of the first coil layer. In some cases the insulator of the first wire is at least partially absent along the first surface of the first coil layer. The second coil layer includes windings of a second wire formed from a conductor and an insulator that electrically insulates the windings of the conductor within the second coil layer. The windings of the second wire define outer first and second surfaces of the second coil layer, and the first and second coil layers are positioned relative to each other with the second surface of the second coil layer facing the first surface of the first coil layer.

According to some embodiments, the insulator of the second wire is also at least partially absent along the second surface of the second coil layer. In some cases a separate insulation layer is included between the first and second coil layers to electrically insulate the first surface of the first coil layer from the second surface of the second coil layer. In some embodiments of the invention, the insulation layer has a thermal conductivity greater than thermal conductivities of the insulator of the first wire and the insulator of the second wire.

According to another aspect of the invention, a thermally conductive electromagnetic coil is provided. The coil includes a plurality of coil layers arranged around a common coil axis. Each coil layer is made from windings of a wire formed from both a conductor and a wire insulator. The windings provide each respective coil layer with a generally planar configuration and outer surfaces that extend perpendicularly with respect to the common coil axis. The coil also includes a generally planar insulation layer between each of the plurality of coil layers. The insulation layer provides a thermal interface between opposing outer surfaces of adjacent coil layers. In some embodiments of the invention, the wire insulators of the adjacent coil layers are at least partially removed along the opposing outer surfaces of each of the adjacent coil layers.

According to another aspect of the invention, a method for manufacturing a thermally conductive electromagnetic coil is provided. The method includes winding a first wire to form a first coil layer and winding a second wire to form a second coil layer. The first coil layer includes a single layer of windings of the first wire that define outer first and second surfaces of the first coil layer. The second coil layer includes a single layer of windings of the second wire that define outer first and second surfaces of the second coil layer. The method further includes removing at least part of an insulator of the first wire along the first surface of the first coil layer and aligning the first coil layer adjacent the second coil layer about a common coil axis with the first surface of the first coil layer facing the second surface of the second coil layer.

In additional embodiments, the method further includes removing at least part of an insulator of the second wire along the second surface of the second coil layer and placing an insulation layer between the first and second coil layers. The insulation layer electrically insulates the first surface of the first coil layer from the second surface of the second coil layer. In some cases the insulation layer has a thermal conductivity greater than thermal conductivities of the insulator of the first wire and the insulator of the second wire.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION OF THE PREFERRED EMBODIMENTS

The following detailed description is exemplary in nature and is not intended to limit the scope, applicability, or configuration of the invention in any way. Rather, the following description provides practical illustrations for implementing exemplary embodiments of the present invention. Examples of constructions, materials, dimensions, and manufacturing processes are provided for selected elements, and all other elements employ that which is known to those of skill in the field of the invention. Those skilled in the art will recognize that many of the examples provided have suitable alternatives that can be utilized.

Embodiments of the present invention provide, among other things, improved thermal conductivity for conducting heat through and away from an electromagnetic coil. According to some embodiments, the invention provides coils, coil assemblies, and coil-based actuators (e.g., electric motors such as linear and planar motors, solenoids, and/or voice coils) that are particularly suitable for use in a precision machine system such as, for example, an exposure apparatus. Such an exposure apparatus can be a photolithography device such as a scanner or stepper for producing micro-devices such as semiconductor wafers, flat panel displays (LCD), or thin-film magnetic heads (TFH). Although several embodiments are discussed herein in the context of linear and planar motors associated with lithography devices, features of the invention may of course be embodied in a wide variety of electromagnetic coils, coil assemblies, and other systems including, without limitation, inductors, transformers, magnetic imaging systems, and other systems incorporating one or more electromagnetic coils.

Figure 1:
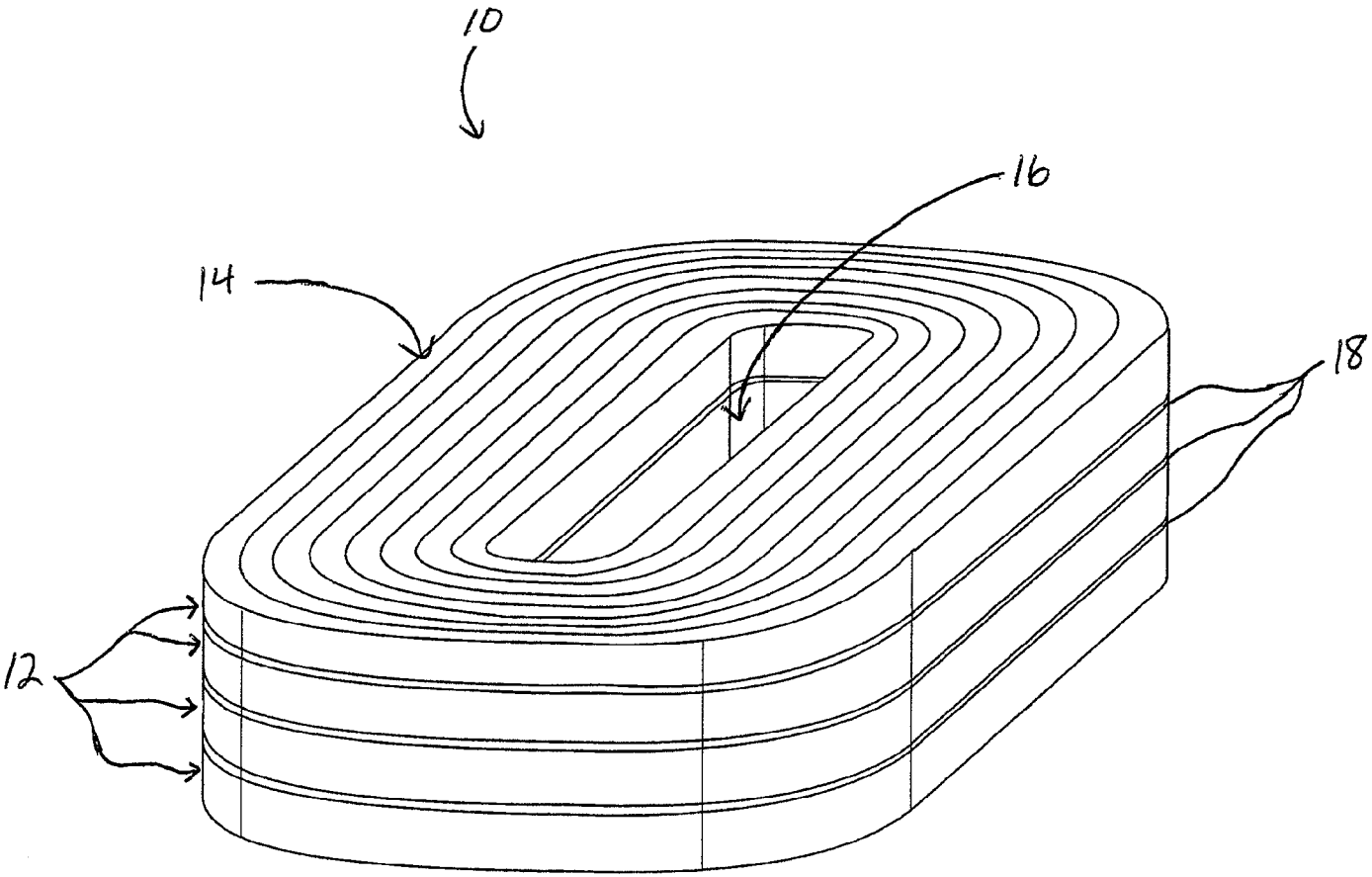
FIG. 1 is a perspective view of a coil according to some embodiments of the invention.

Turning now to FIG. 1, a perspective view of an electromagnetic coil 10 is shown according to some embodiments of the present invention. The coil 10 generally includes a number of coil layers 12, each having multiple windings 14 of wire wound around a core 16. The core 16 can be an actual structural element or alternately may be an air core as shown in FIG. 1. The coil 10 also includes leads or tap points (not shown in FIG. 1) for delivering a current to (or alternately, measuring a voltage or current from) the coil 10. Currents within the coil 10 generate a magnetic field normal to the direction of current flow that can be used in a variety of ways well known to those skilled in the art.

In some embodiments, the coil 10 includes one or more insulation layers 18 positioned between at least some adjacent coil layers 12. It should be appreciated that the figures described herein are not necessarily drawn to scale, but are instead illustrated to render certain elements more discernable and provide a clearer understanding than what might otherwise be available from a scale drawing. As just one example, the insulation layers 18 may in actuality be thicker or thinner than they appear in FIG. 1 and the other figures.

The insulation layers electrically insulate adjacent coil layers while also allowing some amount of heat to pass between coil layers 12. In some embodiments the insulation layers 18 generally provide a thermal conduction path transverse to the orientation of the coil layers 12. This thermal conduction path advantageously allows heat generated within the coil layers 12 to migrate between coil layers 12 and through the coil 10 to one of the coil's exterior surfaces where it can dissipate into the ambient environment (e.g., through passive or active cooling).

Figure 2:
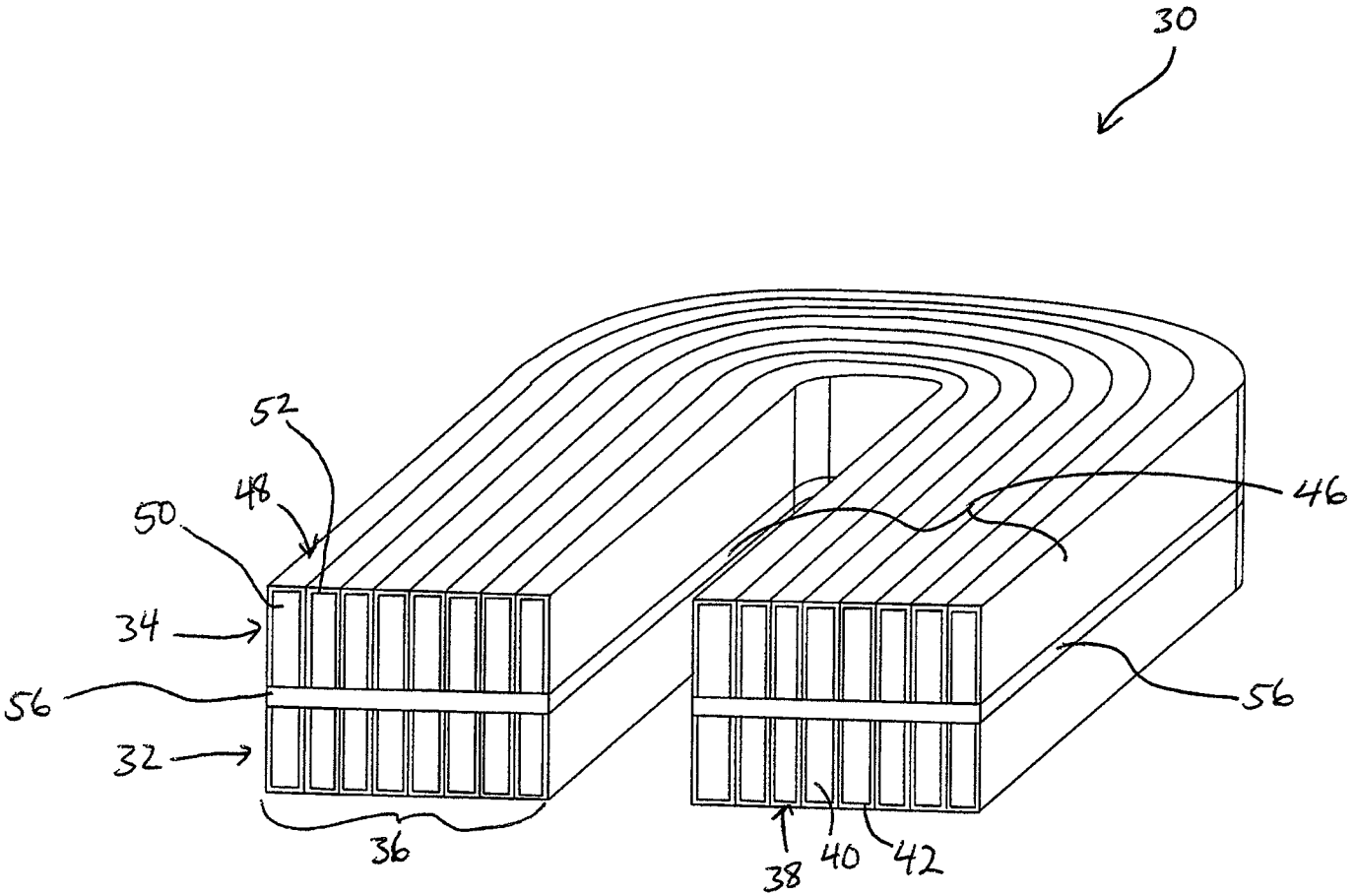
FIG. 2 is a perspective, cross-sectional view of a coil according to some embodiments of the invention.

FIG. 2 is a perspective, cross-sectional view of another coil 30 according to some embodiments of the invention. In this simplified example, the coil 30 includes a first coil layer 32 and a second coil layer 34. The first coil layer 32 includes a number of windings 36 of a first wire 38 wound around the core of the coil. The first wire 38 includes a conductor 40 and an insulator 42 covering the conductor 40, which electrically insulates the windings 36 of the first coil layer 32. Similarly, the second coil layer 34 includes a number of windings 46 of a second wire 48 wound about the coil core. The second wire 48 includes a conductor 50 and an insulator 52 similar to the first wire 38.

For ease of understanding, the coil 30 is illustrated with only two coil layers, although it should be appreciated that many configurations with more than two coil layers and/or different numbers of windings 36, 46 are possible depending upon the particular implementation desired. In addition, the first and second wires 38, 48 can have many different (and not necessarily the same) geometries. For example, in some embodiments, the first and second wires 38, 48 may have a rectangular or square cross-section, or alternatively, a circular or oblong cross-section.

Referring again to FIG. 2, according to some embodiments of the invention, the insulator 42 of the first wire 38 and/or the insulator 52 of the second wire 48 do not extend completely around the first and/or second wires 38, 48 in all places (e.g., the insulator is absent or removed from the wires in one or more places). As will be discussed in greater detail, this can facilitate heat flow between the first and second coil layers 32, 34, thus allowing heat generated within the coil 30 to more easily flow to the exterior surfaces of the coil where it can dissipate into the surrounding environment.

As shown in FIG. 2, in some embodiments the coil 30 may also include a first insulation layer 56 between the first and second coil layers 32, 34. The first insulation layer 56 acts to electrically insulate the first and second coil layers 32, 34, while also providing a thermal interface between the coil layers. For example, the first insulation layer 56 can in some cases be formed from an electrically insulative, yet thermally conductive material to electrically insulate the coil layers while also facilitating heat flow between the coil layers.

The degree of the first insulation layer's thermal conductivity can vary depending upon the particular implementation. For example, the first insulation layer 56 preferably allows some amount of heat flow between the coil layers. In some cases the first insulation layer 56 may be made from the same material as the insulators 42, 52 of the first and second wires 38, 48 and have roughly the same thermal conductivity.

In other embodiments, the first insulation layer 56 may have a greater thermal conductivity than the insulators 42, 52 of the first and second wires 38, 48. For example, the first insulation layer 56 may be formed from a material having a thermal conductivity more than about 10 times greater than the thermal conductivities of the insulators 42, 52 of the first and second wires. In another example, the thermal conductivity of the first insulation layer 56 may be up to 100 times greater than the thermal conductivities of the wire insulators, although no particular minimum or maximum conductivity is required. In some embodiments, the first insulation layer 56 may have a thermal conductivity one to three orders of magnitude higher than the insulators 42, 52 of the first and second wires.

The first insulation layer 56 can comprise a ceramic material, such as, for example, an oxide, a carbide, a boride, a nitride, a sulfide and/or a silicide. In some embodiments, the first insulation layer 56 is made from aluminum nitride (AlN) and has a thermal conductivity of between about 80 and 200 W/mK. In some embodiments, the AlN insulation layer may have a conductivity of between about 100 and 170 W/mK. Other possible materials for the first insulation layer 56 include but are not limited to beryllium oxide, silicon, and diamond.

Figure 3:
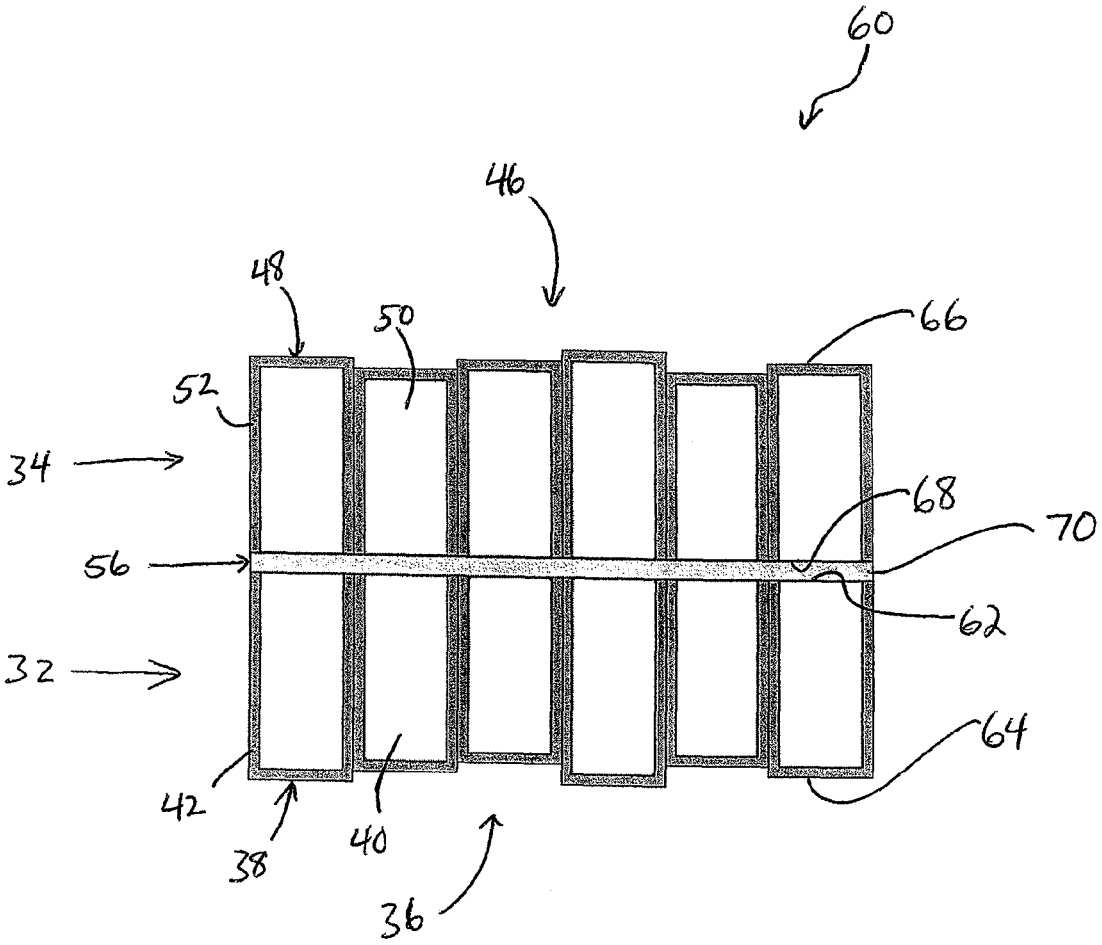
FIG. 3 is a partial cross-sectional view of a coil according to some embodiments of the invention.

Turning now to FIG. 3, a cross-sectional view of a portion of a coil 60 is illustrated according to some embodiments of the invention. The windings 36 of the first coil layer 32 define opposing outer first and second surfaces 62, 64 of the first coil layer 32. Similarly, the windings 46 of the second coil layer 34 define opposing outer first and second surfaces 66, 68 of the second coil layer 34. The first coil layer 32 is positioned adjacent the second coil layer 34 with the second surface 68 of the second coil layer facing the first surface 62 of the first coil layer.

Continuing to refer to FIG. 3, in some embodiments of the invention the insulator of one or more of the first and second wires 38, 48 does not extend completely around the first and second wire, respectively. As shown in detail in FIG. 3, for example, in some embodiments the insulator 42 may be absent from the windings 36 of the first wire 38 along its first surface 62. The insulator 52 may also be removed from the windings 46 of the second wire 48 along its second surface 68.

Depending upon the specific embodiment, the insulator of the first and/or second wires 38, 48 may be absent to varying degrees and need not be completely removed as shown in FIG. 3. For example, the insulator of a wire may only be partially absent along the surface of the windings of the first and/or second wires 38, 48. In some embodiments the insulator is completely removed along a surface of one coil layer but not the other. For example, in some cases the insulator 42 may be completely absent along the first surface 62 of the first coil layer 32 and the insulator 52 may be completely present along the second surface 68 of the second coil layer 34.

The at least partial absence of the insulator from one or more of the first and second wires 38, 48 can increase the overall or bulk thermal conductivity of the coil 60, thus providing improved transfer of heat to the exterior of the coil 60 when compared with conventional coils in which the insulator completely encloses the coil windings. Unfortunately, typical insulations provided around the conductors in conventional coils can have a very low thermal conductivity. For example, the inventors have determined that some types of insulation, such as the standard polymeric varnishes used to insulate the windings of electric motor coils, can have thermal conductivities below about 1 W/mK, for example 0.1-0.3 W/mK.

Thus, while conventional insulation configurations electrically insulate the conductor, they also thermally insulate the conductor, effectively trapping heat within the windings of the conventional coil. For example, the bulk thermal conductivity of a conventional coil can drop to about 2 W/mK even though the thermal conductivity of solid copper conductors approaches about 400 W/mK. According to some embodiments of the invention, the at least partial absence of the insulators 42, 52 from one or more of the first and second wires 38, 48 can advantageously provide a more thermally conductive path within the coil 60 for heat to flow to the exterior of the coil.

As shown in FIG. 3, in some embodiments the first insulation layer 56 may optionally be provided between the first and second coil layers 32, 34. The first insulation layer 56 electrically isolates the first and second coil layers 32, 34, while also allowing some amount of heat to flow between the coil layers. For example, in some embodiments in which both the insulators 42, 52 are at least partially absent along both the first and second surfaces 62, 68 of the first and second coil layers 32, 34, respectively, the first insulation layer 56 can electrically insulate the first and second coil layers 32, 34 and also provide a thermally conductive interface between the coil layers.

In some embodiments the first insulation layer 56 comprises an insulating sheet 70. According to some embodiments, the insulating sheet 70 is an integral sheet of insulating material sandwiched between the first and second coil layers 32, 34. For example, the insulating sheet 70 can extend through the coil 60 covering the entirety or only a portion of the first surface 62 of the first coil layer 32. In some embodiments, the extent of the insulating sheet 70 is configured to ensure the insulating sheet 70 provides an electrically insulating layer between all exposed portions of the first and second wires 38, 48 (e.g., where the insulators 42, 52 are absent from the wires).

The thickness of the insulating sheet 70 may vary depending upon, for example, the thermal conductivity, strength, and other properties of the material used. In some cases the thickness of the insulating sheet 70 is determined based on the thermal conductivity of the material used. In some cases the thickness is determined based on the relative fractions of the coil occupied by the insulating sheet 70 and the conductors and the field strength capable of being produced. In some embodiments, the insulating sheet 70 comprises aluminum nitride and is between about 10 μm and 500 μm thick. In some preferred embodiments, the insulating sheet 70 is about 200 μm thick or less. In still further embodiments, the insulating sheet is about 40 μm thick. Of course these thicknesses are just examples and other thicknesses are also contemplated.

According to some embodiments of the invention, one or more surfaces of the coil layers of the coil 60 are relatively smooth (e.g. relatively smooth curved, bent, flat and/or planar surfaces), thus providing a close, intimate interface between coil layers or alternately between one or both of the coil layers 32, 34 and the first insulation layer 56 (e.g., the insulating sheet 70). As shown in FIG. 3, for example, the first surface 62 of the first coil layer 32 and the second surface 68 of the second coil layer 34 are relatively flat or planar, especially when compared with the second surface 64 of the first coil layer and the first surface 66 of the second coil layer.

The smooth surfaces of the coil layers provide a close, intimate thermal interface with the first insulation layer 56, thus increasing the thermal conductivity between the coil layers and/or the first insulation layer 56. In contrast, the windings of conventional coil designs can be misaligned to some degree, leading to an uneven interface and small gaps between coil layers, which decreases thermal conduction between the coil layers.

While air gaps between the coil layers can significantly decrease thermal conduction, adhesives such as epoxies can also decrease thermal conduction between coil layers. For example, typical epoxies used with electrical motor coils can have a thermal conductivity of less than about 1 W/mK. This can hinder thermal conduction when epoxy fills the small gaps between coil layers, thus providing a thermally insulative barrier between the coil layers. According to some embodiments of the invention, relatively smooth surfaces of one or more coil layers can minimize the amount of epoxy that typically aggregates within the gaps of misaligned coil layers, thus increasing the bulk thermal conductivity of the coil.

With continued reference to FIG. 3, in some embodiments the first and second surfaces 62, 68 of the first and second coil layers 32, 34 are machined surfaces. For example, the surfaces may be machined relatively smooth. In some embodiments, one or more of the first and second surfaces may be machined to create surfaces that are relatively smooth, thus minimizing the presence of pockets of air or epoxy, if any, and providing a close thermal interface between the first and second surfaces 62, 68 and the first insulation layer 56.

In some embodiments the coil and coil layers may be formed in a variety of overall geometries while also providing relatively smooth, adjacent layer surfaces. For example, a coil or coil layer may have a generally planar or flat configuration, or may have a curved or bent configuration. It should also be appreciated that the specific surface smoothness or, alternately, roughness required in a given application can vary, and can be established according to the requirements of efficiency, cooling performance, cost, and/or the mechanical tolerances required for the specific application. For example, in some cases a finite amount of surface roughness may be tolerated. The desired surface roughness can also vary according to the size of the coil.

According to some embodiments of the invention, a thin layer of thermally conductive material can be applied between coil surfaces 62, 68 or between the first insulation layer 56 and the coil surfaces 62, 68 to reduce the thermal contact resistance at the layer interface. For example, in some embodiments a thin layer of thermal grease may be applied between the first insulation layer 56 and the first and second surfaces 62, 68 of the first and second coil layers 32, 34 to increase the thermal conductivity between the coil layers and the first insulation layer.

As previously discussed, typical adhesives used to hold together coil windings often have a low thermal conductivity, therefore limiting the bulk thermal conductivity of a coil. According to some embodiments of the invention, an adhesive or epoxy may be used to hold together the first coil layer 32, the insulating sheet 70, and the second coil layer 34. However, in some cases, the adhesive may be applied as a discontinuous layer or in patches or lines such that only some portions of the coil layers and insulating sheet have adhesive, while other portions of the surfaces 62, 68 are in direct contact with the insulating sheet 70. In another embodiment, the first and second surfaces 62, 68 and/or the surfaces of the insulating sheet 70 may be formed with raised surface features, such as ribs, which allow direct contact between the coil layer surfaces and the insulating sheet, while allowing an adhesive between the ribs to hold the components together. In yet another embodiment, a mechanical structure may clamp or hold the coil layers 32, 34 and the insulating sheet 70 together.

Figure 4A:
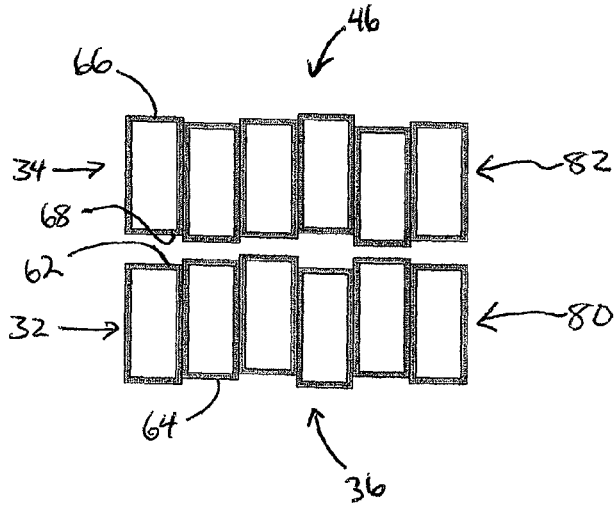
FIGS. 4A-4C are partial, cross-sectional views of a coil illustrating steps in a method of manufacturing the coil of FIG. 3 according to some embodiments of the invention.
Figure 4B:
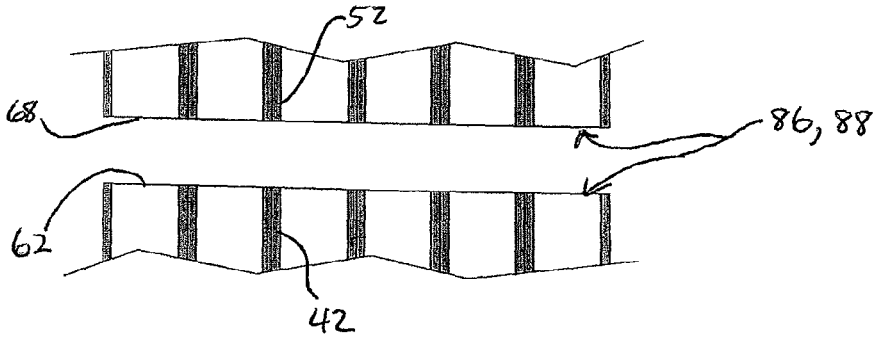
Figure 4C:
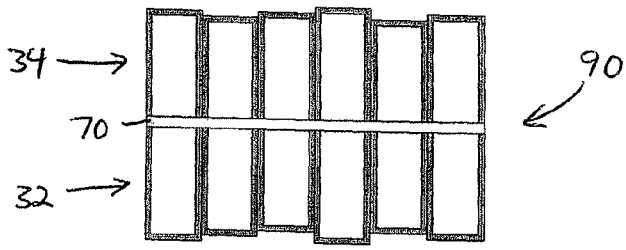

Turning now to FIGS. 4A-4C, partial, cross-sectional views are shown illustrating steps in a method of manufacturing the coil of FIG. 3 according to some embodiments of the invention. As shown in FIG. 4A, the method includes winding 80 a first wire to form a first coil layer 32 and winding 82 a second wire to form a second coil layer 34. The first coil layer 32 includes a single layer of windings of the first wire and the second coil layer 34 includes a single layer of windings of the second wire. The windings define first and second surfaces of each coil layer as previously discussed with reference to FIG. 3.

Turning to FIG. 4B, after forming one or both of the first and second coil layers 32, 34, the method of manufacture includes removing 86 at least part of the insulators 42, 52 of the first and/or second wires along the respective first surface 62 of the first coil layer and/or the second surface 68 of the second coil layer. The insulators can be removed to varying degrees, including completely removing or just partially removing the insulators along the surfaces of the coil layers. In some embodiments, the insulators may be removed by machining the first surface 62 and/or the second surface 68 as shown in FIG. 4B. A variety of processes can be used to remove the insulators and the invention is not limited to any particular process. As just a few examples, the insulators may be partially removed through machining, grinding, sanding, and/or polishing. In some cases the insulators may be removed through electrical and/or chemical processes such as etching, e-beam machining, or lithography.

As shown in FIG. 4A, after initially winding the first and second coil layers 32, 34, in some embodiments the windings 36 of the first coil layer and the windings 46 of the second coil layer may be somewhat misaligned, providing uneven or discontinuous coil layer surfaces 62, 68, respectively. Accordingly, after winding a coil layer, the method of manufacture may also include machining 88 the first surface 62 of the first coil layer relatively smooth and/or the second surface 68 of the second coil layer relatively smooth. In addition to providing relatively smooth (e.g., flat) surfaces of the coil layers, this step of machining can also remove the insulators 42, 52 of the first and/or second wires as discussed above.

While some embodiments may include sequentially winding a layer, smoothing a surface of the layer, and then winding another layer, and so on, methods of manufacturing coils described herein are not limited to any particular order of steps. In some embodiments, the method of manufacture includes forming the coil layers separately and then smoothing one or both sides of each coil layer prior to assembling the layers into a coil. For example, for a planar coil with more than two layers, a method may include winding each layer, machining both sides of each layer flat, and then stacking the layers together with one or more insulation layers.

Turning to FIG. 4C, after removing at least part of the wire insulators and optionally machining the coil layer surfaces smooth, the coil construction process includes aligning 90 the first coil layer adjacent the second coil layer about a common coil axis (not shown), with the first surface 62 of the first coil layer 32 facing the second surface 68 of the second coil layer 34. In some cases the insulating sheet 70 (i.e., first insulation layer 56) is placed between the first and second coil layers 32, 34 to electrically insulate the first surface 62 of the first coil layer from the second surface 68 of the second coil layer. In some cases this involves stacking the coil layers and insulating sheet 70, and then optionally holding them together with an adhesive and/or mechanical clamp as discussed above.

Figure 5:
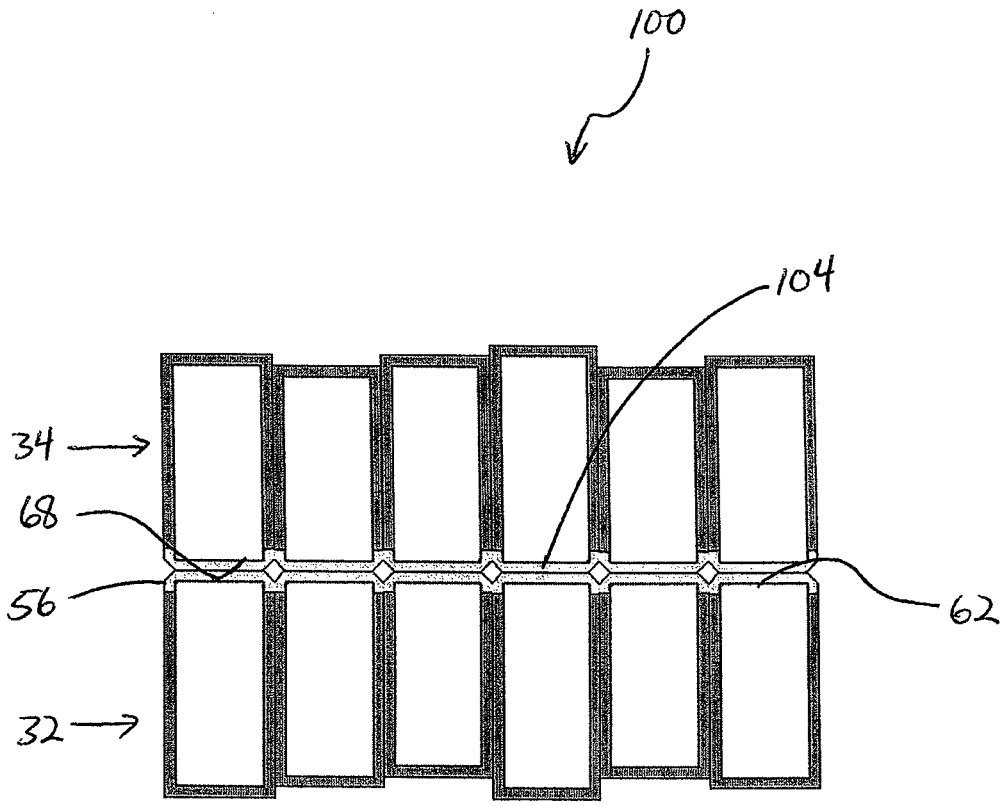
FIG. 5 is a partial cross-sectional view of a coil according to some embodiments of the invention.

FIG. 5 is a partial cross-sectional view of a coil 100 according to an alternative embodiment of the invention. In this embodiment, the first insulation layer 56 comprises a coating on the first surface 62 of the first coil layer 32. For example, the coating may be a thin film deposited onto the first surface 62. The coating preferably comprises an electrically insulating and thermally conducting material, and may include, for example, any of the materials described with respect to the insulating sheet 70 of FIG. 3.

In some embodiments, the coil 100 includes a second insulation layer 104 that comprises a coating on the second surface 68 of the second coil layer 34. For example, the coating may be a thin film deposited onto the second surface 68 to electrically insulate the second coil layer 34 from the first coil layer 32, while also allowing some heat transfer between the coil layers. The second coating may include, for example, any of the materials described above with respect to the insulating sheet 70 of FIG. 3. While some embodiments include both first and second insulation layers 56, 104 in the form of dual coatings, in some cases the coil 100 may include only one of the first and second insulation layers as a single coating between the first and second coil layers 32, 34.

Figure 6A:
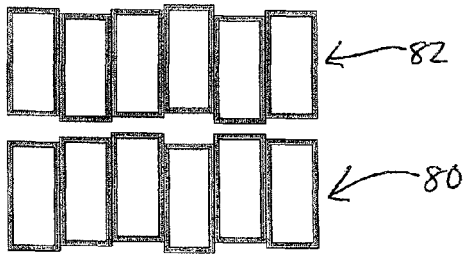
FIG. 6A-6D are partial, cross-sectional views of a coil illustrating steps in a method of manufacturing the coil of FIG. 5 according to some embodiments of the invention.
Figure 6B:
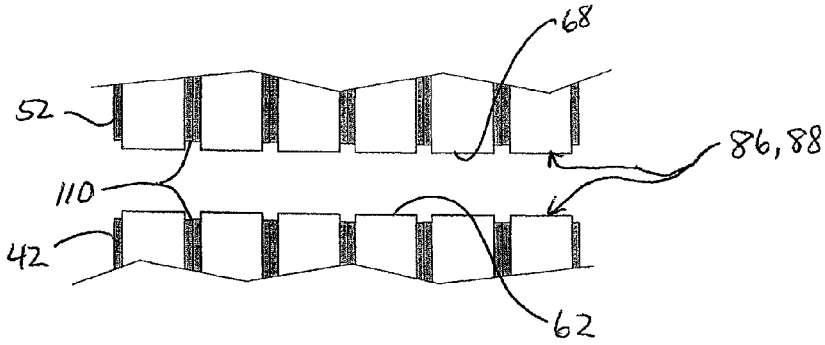

FIGS. 6A-6D are partial, cross-sectional views illustrating steps in a method of manufacturing the coil 100 of FIG. 5 according to some embodiments of the invention. As shown in FIGS. 6A-6B, the method includes winding 80 the first coil layer and winding 82 the second coil layer, and removing 86 at least part of the insulator of the first wire along the first surface of the first coil layer, and optionally, at least part of the insulator of the second wire along the second surface of the second coil layer. In some embodiments, the insulators 42, 52 may be removed by machining 88 as described above, which optionally also smooths (e.g., flattens or planarizes) the first and second coil surfaces 62, 68 to some degree.

Figure 6C:
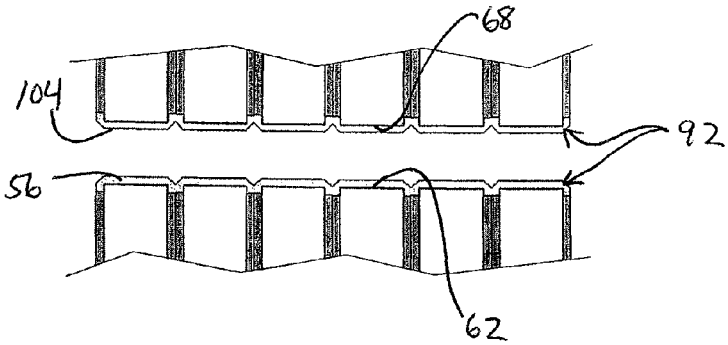

Turning to FIG. 6C, the method includes depositing 92 the first coating (i.e., the first insulation layer 56) upon the first surface 62 of the first coil layer 32 and optionally depositing 92 the second coating (i.e., the second insulation layer 104) upon the second surface 68 of the second coil layer 34. As shown in FIG. 6B, in some cases the machining 88 (or other removal of the insulators 42, 52) of the first or second surfaces 62, 68 may also remove portions of the insulators 42, 52, leaving small gaps 110 in the insulation between windings. As shown in FIG. 6C, in some embodiments the first and second coatings advantageously fill at least part of the gaps 110, thus sealing the windings with an electrically insulative material and reducing the risk of short circuits across the windings.

The first and/or second insulation layers 56, 104 (e.g., the coatings) can be deposited 92 upon the coil layers by any suitable method. For example, in some embodiments, the coatings may be painted on by hand or machine. In other cases, the coatings may be deposited as a thin film via a chemical or physical vapor deposition process.

Figure 6D:
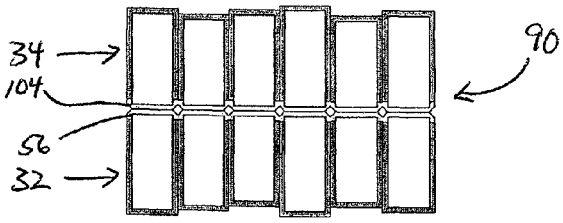

Turning to FIG. 6D, after applying the coatings, the first and second coil layers are aligned 90 about a common coil axis (not shown) with the first surface 62 of the first coil layer 32 facing the second surface 68 of the second coil layer 34 and with the first coating in contact with the second coating. The first and second coil layers 32, 34 may be held together with a fastener such as an adhesive, a mechanical clamp, or another similar structure.

Figure 7:
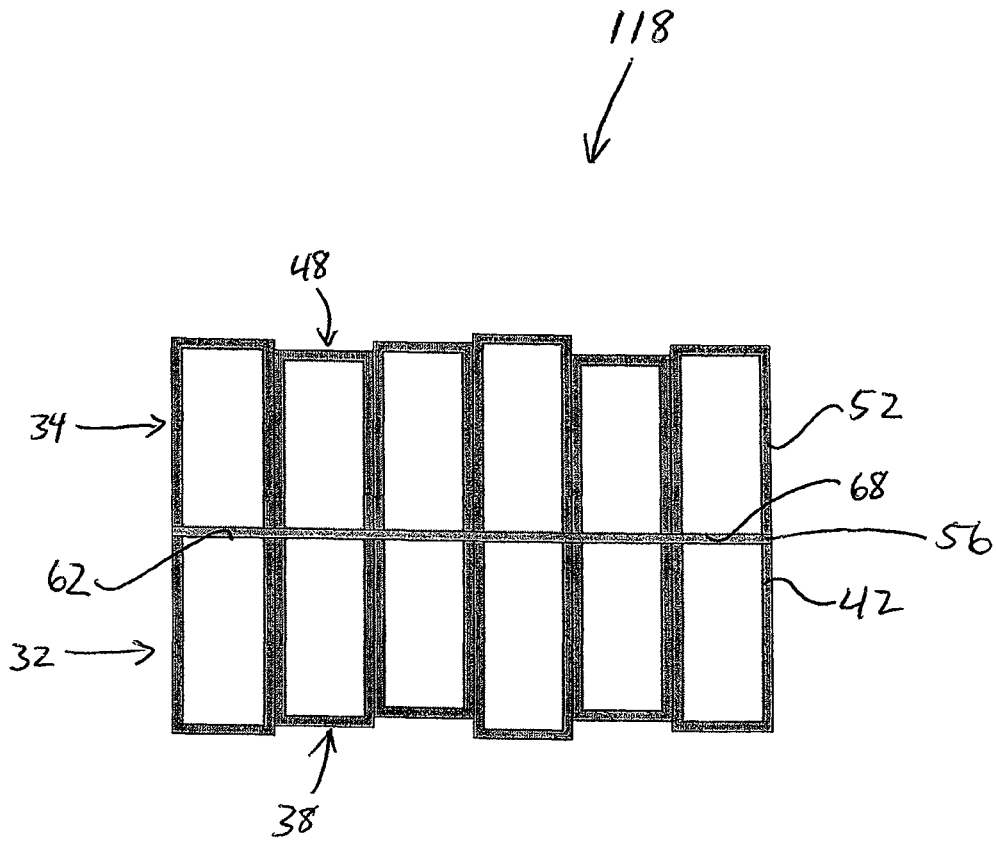
FIG. 7 is a partial cross-sectional view of a coil according to some embodiments of the invention.

FIG. 7 is a partial cross-sectional view of a coil 118 according to another embodiment of the invention. The coil 118 is similar in many respects to the coils 60, 100 illustrated in FIGS. 3 and 5. As shown in FIG. 7, in this embodiment the insulator 42 is absent along the first surface 62 of the first coil and the insulator 52 is absent along the second surface 68 of the second coil. According to some embodiments, the first insulation layer 56 can include a thin layer of the same material used for the insulators 42, 52 about the first and second wires 38, 48. For example, in some cases the first insulation layer 56 may have a thickness similar to the thickness of the insulators 42, 52 on the first and second wires. In some cases, the thickness can be about 20 μm.

The first insulation layer 56 electrically insulates the first and second coil layers 32, 34, while also allowing some amount of heat to pass between the coil layers. For example, the first insulation layer 56 in this embodiment may comprise a single layer of polymeric varnish with a relatively low thermal conductivity, similar to the thermal conductivities of the insulators 42, 52 about the first and second wires 38, 48. However, because at least portions of the insulators 42, 52 are absent, respectively, along the first and second surfaces of the first and second coil layers, the first insulation layer 56 can provide a less thermally insulative barrier than the combined insulative effect of both the insulators 42, 52 about the first and second wires.

Further, in some cases the first surface 62 of the first coil layer 32 and/or the second surface 68 of the second coil layer 34 may be machined relatively smooth, thus providing a close, intimate thermal contact between the coil layers. In some embodiments the first and second surfaces 62, 68 are machined relatively smooth (e.g., flat) to minimize the presence of relatively thick portions of epoxy, if any, which can decrease the bulk thermal conductivity of the coil.

Figure 8A:
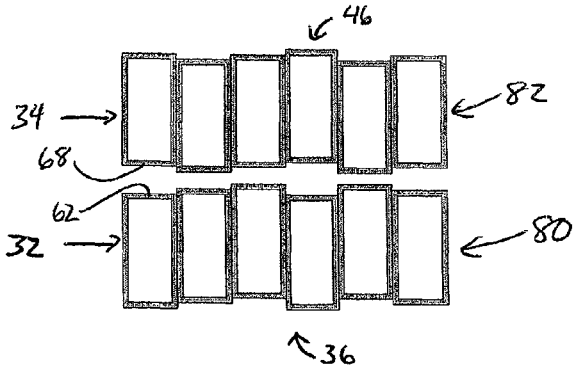
FIG. 8A-8D are partial, cross-sectional views of a coil illustrating steps in a method of manufacturing the coil of FIG. 7 according to some embodiments of the invention.

FIGS. 8A-8D are partial, cross-sectional views of a coil illustrating steps in a method of manufacturing the coil of FIG. 7 according to some embodiments of the invention. As shown in FIG. 8A, the method includes winding 80 a first wire to form a first coil layer 32 and winding 82 a second wire to form a second coil layer 34. The first coil layer 32 includes a single layer of windings of the first wire and the second coil layer 34 includes a single layer of windings of the second wire. The windings define first and second surfaces of each coil layer as previously discussed with reference to FIG. 3.

Figure 8B:
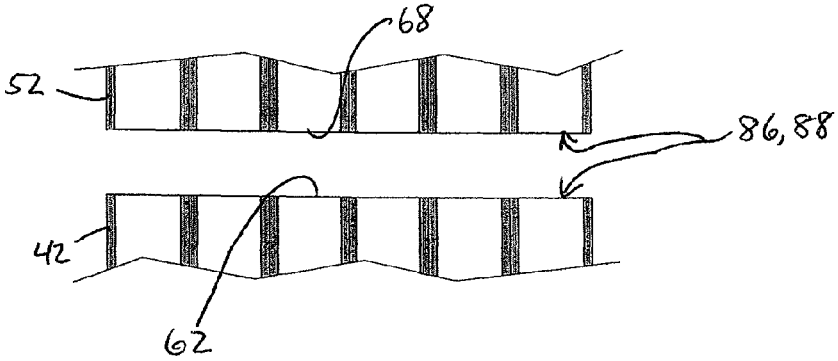

Turning to FIG. 8B, after forming the first and/or second coil layers 32, 34, the method of manufacture includes removing 86 at least part of the insulators 42, 52 of the first and/or second wires along the respective first surface 62 of the first coil layer and/or the second surface 68 of the second coil layer. The insulators can be removed to varying degrees, including completely removing or just partially removing the insulator along the surface of the coil layer. In some embodiments, the insulators may be removed by machining the first surface 62 and/or the second surface 68. Of course, other processes may be used to remove portions of the insulators.

As shown in FIG. 8A, after winding the first and second coil layers 32, 34, the windings 36 of the first coil layer and the windings 46 of the second coil layer may be somewhat misaligned, providing uneven or discontinuous coil layer surfaces 62, 68, respectively. Accordingly, after winding a coil layer, the method of manufacture may also include machining 88 the first surface 62 of the first coil layer relatively smooth and/or the second surface 68 of the second coil layer relatively smooth. In addition to providing relatively smooth surfaces of the coil layers, this step of machining can also remove the insulators 42, 52 of the first and/or second wires as discussed above.

Figure 8C:
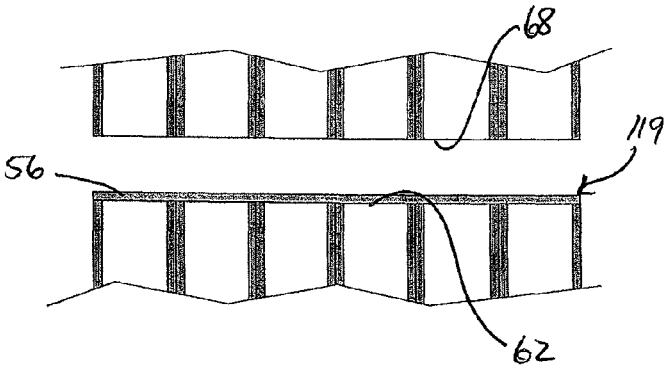

Turning to FIG. 8C, in some embodiments, after removing at least part of the wire insulators 42, 52 and optionally machining the coil layer surfaces relatively smooth, the coil construction process includes placing 119 the first insulation layer 56 upon the first surface 62 of the first coil layer 32 (or optionally the second surface 68 of the second coil layer 34). For example, the first insulation layer 56 may be painted, coated, or otherwise deposited upon the coil surface. According to some embodiments, the first insulation layer 56 comprises the same material as the insulators 42, 52 of the first and second wires (e.g., a polymeric varnish). In other embodiments, the first insulation layer 56 may comprise a different material.

Figure 8D:
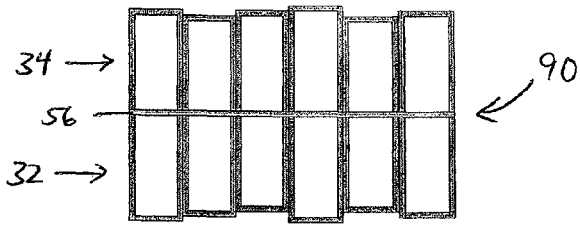

As shown in FIG. 8D, after placing 119 the first insulation layer 56, the first and second coil layers are aligned 90 about a common coil axis (not shown) with the first surface 62 of the first coil layer 32 facing the second surface 68 of the second coil layer 34. In some cases the first and second coil layers 32, 34 are held together with an adhesive and/or mechanical clamp as discussed above.

Figure 9:
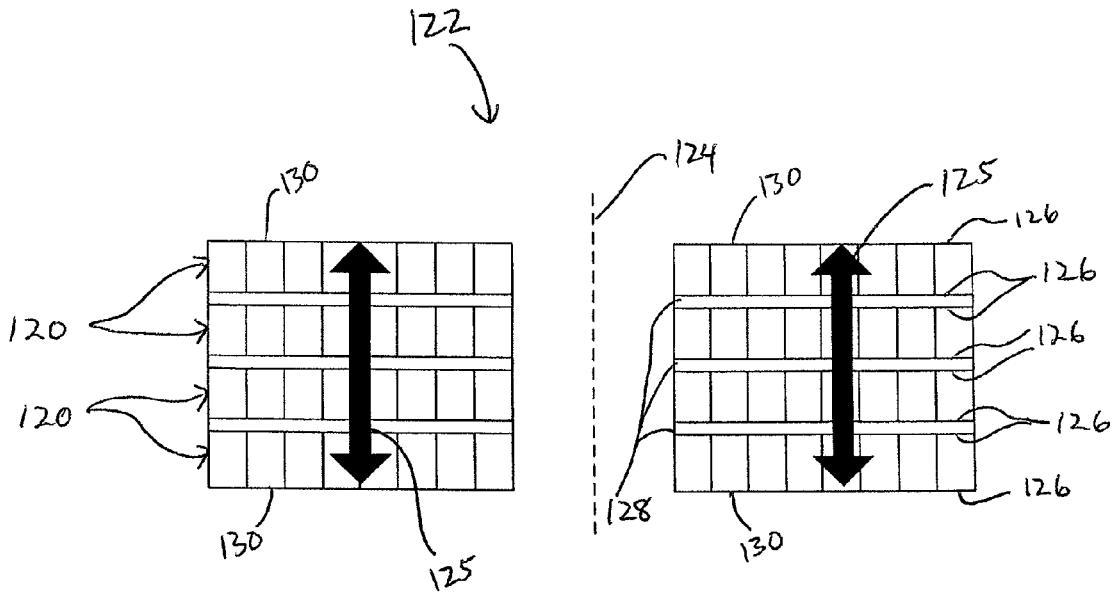
FIG. 9 is a cross-sectional view of a coil according to some embodiments of the invention.
Figure 10:
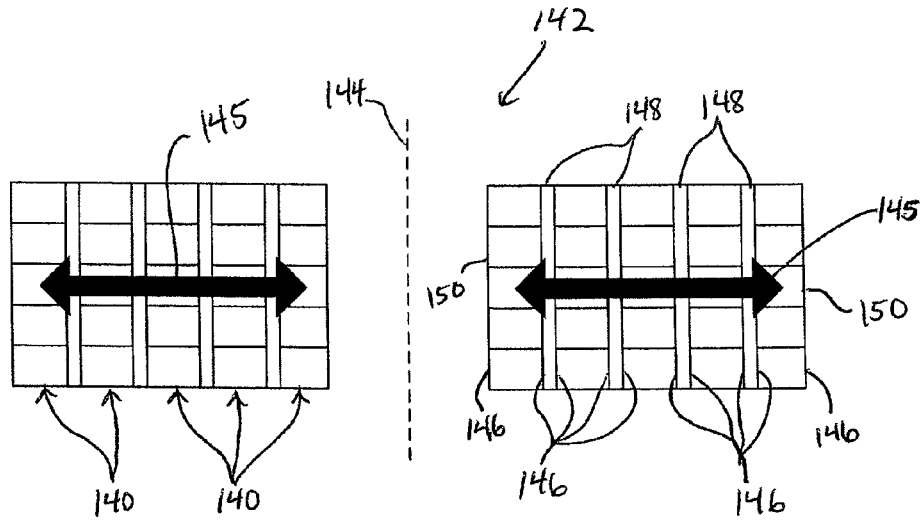
FIG. 10 is a cross-sectional view of a coil according to some embodiments of the invention.

Turning now to FIGS. 9 and 10, the layers of a coil, the outer surfaces of a coil layer, and optionally, one or more insulation layers, can have multiple orientations according to different embodiments of the invention. Thus, terms such as coil layer, insulation layer, and outer surfaces of a coil layer are not intended to only describe one orientation of these elements, but include a variety of orientations.

FIG. 9 is a cross-sectional view of a coil 122 according to some embodiments, in which a plurality of coil layers 120 can be arranged around a common coil axis 124, with the coil layers extending perpendicularly about the common coil axis 124. In this embodiment, each coil layer 120 includes windings of a wire including a conductor and a wire insulator (not shown in FIG. 9). The windings provide each respective coil layer 120 with a generally planar configuration normal to the common coil axis 124.

The outer surfaces 126 of the coil layers 120 also extend perpendicularly about the common coil axis 124. Accordingly, the absence of wire insulator along a portion or all of these outer surfaces 126 can promote heat conduction between the coil layers 120 in a direction 125 generally parallel to the coil axis 124. In some embodiments, the coil 122 also includes generally planar insulation layers 128 between each of the coil layers 120, thus providing a thermal interface between opposing outer surfaces 126 of adjacent coil layers 120, and also facilitating heat conduction between coil layers 120 in the direction 125 generally parallel to the coil axis 124. The parallel direction 125 of heat flow can be especially helpful when exterior surfaces 130 of the coil 122 provide a relatively large surface area for cooling. For example, this orientation can be useful for the generally flat coils found in some linear and planar motors.

FIG. 10 is a cross-sectional view of a coil 142 according to some embodiments, in which a plurality of coil layers 140 are arranged around a common coil axis 144, with the coil layers extending in a direction generally parallel to the coil axis 144. In this case, the coil layers 140 are generally wrapped about the coil axis 144 at increasing perpendicular distances. The outer surfaces 146 of the coil layers 140 also extend parallel to the coil axis 144. Accordingly, the absence of wire insulator along a portion or all of these outer surfaces 146 can promote heat conduction between the coil layers 140 in a direction 145 generally perpendicular to the coil axis 144. Further, in embodiments including insulation layers 148 between adjacent coil layers 140, the insulation layers 148 can also promote heat transfer between the coil layers 140 in the direction 145 generally perpendicular to the coil axis 144 to the exterior surfaces 150 of the coil.

Referring again to FIG. 9, in some embodiments the shape of the wire in each winding can be selected to further increase the thermal conductivity in a particular direction. For example, in the case that heat flow is being maximized in the direction 125 parallel to the coil axis, a rectangular wire having its longest cross-sectional dimension also parallel with the coil axis can maximize the amount of conductor along the direction 125 of heat flow. This increases the proportion of conductor to insulator in the direction 125, also increasing the thermal conductivity accordingly due to the higher thermal conductivity of the conductor when compared with the wire insulator (or insulation layer 128).

Conversely, selecting a wire with its longest cross-sectional dimension perpendicular to the coil axis can maximize the amount of conductor along the direction 145 of heat flow as shown in FIG. 10.

Referring back to FIG. 3, according to some embodiments of the invention, the insulators 42, 52 of the first and second wires 38, 48 can be modified to further increase the thermal conductivity within a given coil. For example, in some embodiments the first and/or second wires 38, 48 include conductors 40, 50 that can be coated with an electrically insulating, highly thermally conductive material. Thus, instead of being coated with a low thermal conductivity material such as the typical polymeric varnishes used in electric motor coils, the conductors are coated with a material with a high thermal conductivity. For example, the conductors may be coated with a thin layer of ceramic material such as, for example, AlN, or in some cases diamond. Of course other materials may be used as well. It is contemplated that in some embodiments the coating can be deposited on the conductor with a deposition process such as a chemical or physical vapor deposition process. Thus, a thermally conductive insulator on the first and/or second wires could greatly increase the bulk thermal conductivity of the coil.

Features of the invention may be incorporated into a wide variety of electric devices, including actuators such as linear and planar motors, to provide improved thermal conductivity according to various embodiments of the invention. As just one example, a linear motor such as the motor described in commonly-assigned U.S. Pat. No. 6,570,273, the contents of which are incorporated herein by reference, can be provided with improved thermal conductivity according to embodiments of the invention. As another example, a planar motor such as the motor described in commonly-assigned U.S. Pat. No. 6,114,781, the contents of which are incorporated herein by reference, can be provided with improved thermal conductivity according to embodiments of the invention.

Although several embodiments are discussed herein in the context of linear and planar motors associated with lithography devices, features of the invention may of course be embodied in numerous electromagnetic coils, coil assemblies, and other systems including, without limitation, inductors, transformers, magnetic imaging systems, solenoids, voice coils, and other systems incorporating one or more electromagnetic coils.

Figure 11A:
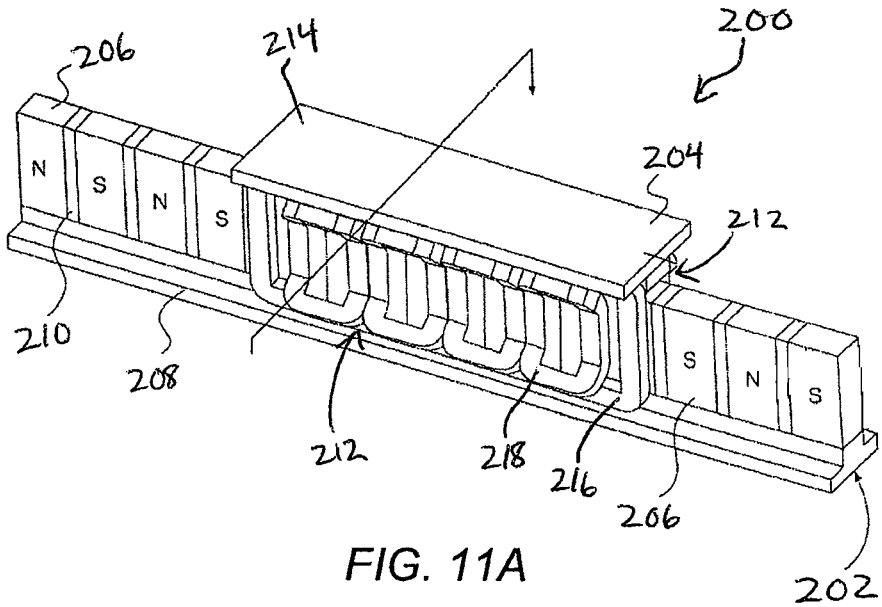
FIGS. 11A and 11B are perspective views of a linear motor according to some embodiments of the invention.
Figure 11B:
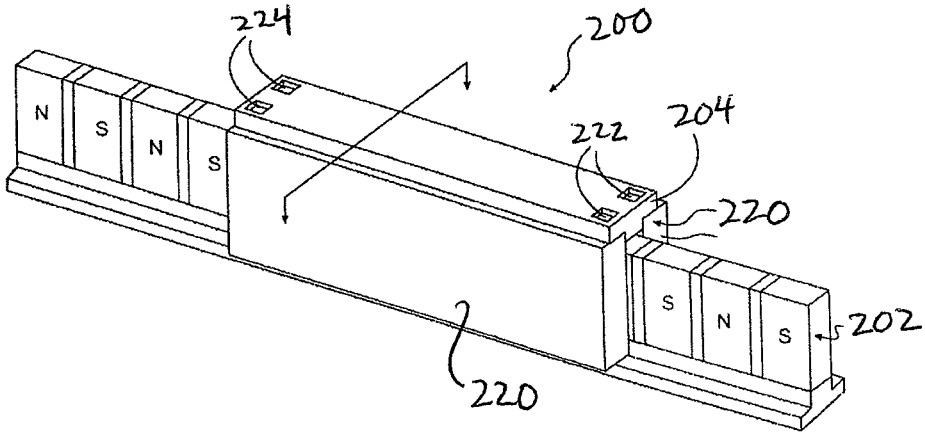

FIGS. 11A and 11B are perspective views of a electric linear motor 200, similar to that disclosed in U.S. Pat. No. 6,570,273, incorporating features of the invention according to some embodiments. The linear motor 200 includes a magnet assembly 202 and a coil assembly 204 slideably disposed around a portion of the magnet assembly 202. The interface between the magnet assembly 202 and the coil assembly 204 is preferably frictionless. For example, the interface may be an air bearing although other low friction interfaces are possible.

The magnet assembly 202 has a number of magnets 206 attached to a base member 208. Each magnet has two opposing surfaces containing opposite magnetic poles (N and S) aligned to form a single row of magnets 206 with alternating magnetic poles. In addition, spacers 210 may be interposed between the magnets 206. The spacers 210 are preferably held in place using an adhesive or fasteners such as screws.

According to some embodiments, the coil assembly 204 includes two walls 212 attached to a header 214. Each of the walls 212 is formed form a number of flat coils 216 and bent coils 218. The flat coils 216 are juxtaposed, (i.e., put side by side) and attached to the header 214 with the bent coils 218 interlocked with the flat coils 216. According to some embodiments, the flat coils and/or the bent coils 218 are configured as thermally conductive coils, such as any of those described above with respect to FIGS. 1-10. As just one example, each of the flat coils 216 and the bent coils 218 can include a number of coil layers with interspersed thermally-conductive insulation layers comprising a deposited coating or thin film. According to some embodiments, the insulation layers facilitate heat transfer between coil layers, thus enabling greater heat transfer out of each coil.

FIG. 11B illustrates an embodiment of the electric linear motor 200 in which the coil assembly 204 includes two cooling compartments 220, one enclosing the coils of each wall 212. According to some embodiments, a coolant flows through the compartments 220 to prevent the environment external to the linear motor 200 from increasing in temperature by more than a predetermined temperature rise. The coolant is driven through the cooling compartments 220 via fluid ingress ports 222 and fluid egress ports 224.

According to some embodiments of the invention, one or more coils 216, 218 within the cooling compartments 220 may be configured to provide even greater cooling to the coils. For example, in some embodiments the wire insulator may be at least partially removed or absent along one or more exterior surfaces of the coil to increase the thermal transfer between the coil and the coolant, which may be electrically non-conductive. Referring to FIG. 3, for example, the second surface 64 of the first coil layer 32 may be considered an outer coil surface in contact with the coolant. In some cases, the insulator 42 around the first wire 38 may be partially or wholly absent along the second surface 64 of the first coil layer 32. Thus, the conductor 40 can be in direct contact with the coolant, providing an increased level of cooling for the coil. Likewise, in some case the insulator 52 of the second wire 48 may also be partially or wholly absent along the first surface 66 of the second coil layer 34.

Figure 12:
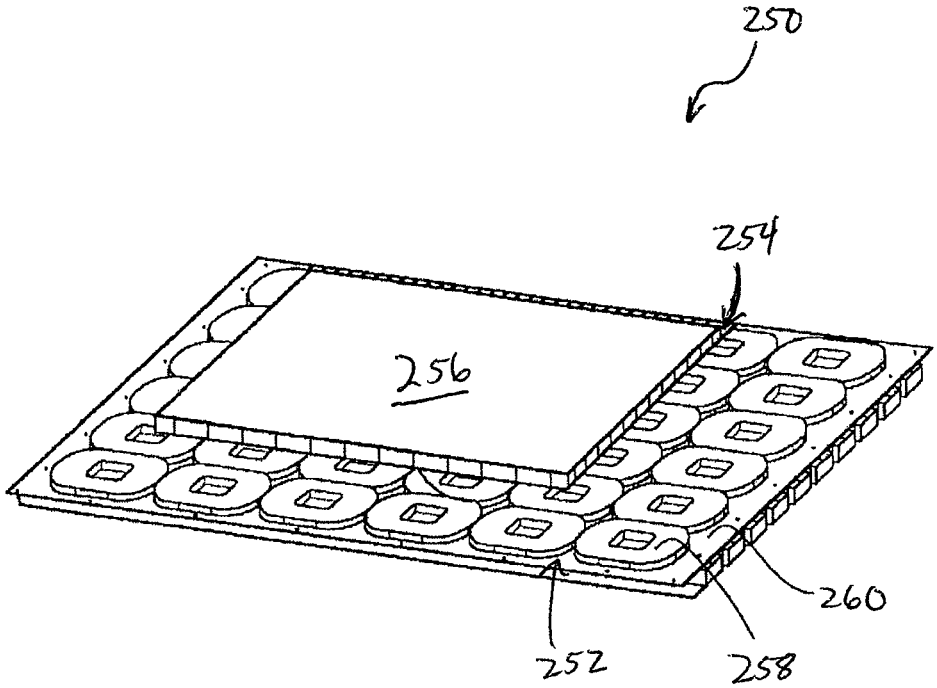
FIG. 12 is a perspective view of a planar motor according to some embodiments of the invention.

FIG. 12 is a perspective view of a planar motor 250, similar to that disclosed in U.S. Pat. No. 6,114,781, that incorporates features of the invention. The planar motor 250 includes a flat planar coil assembly or array 252, similar to that described in Andrew J. Hazelton, Michael B. Binnard et al., "Electric Motors and Positioning Devices Having Moving Magnet Arrays and Six Degrees of Freedom", U.S. patent application Ser. No. 09/192,813, filed Nov. 16, 1998, incorporated herein by reference in its entirety and commonly assigned. A magnet array 254 is attached to a moving portion of a positioning stage 256.

In this embodiment, coils 258 of coil array 252 are attached to a fixed platen 260. Some or all of the coils 258 are configured as thermally conductive coils, such as any of those described above with respect to FIGS. 1-10. As just one example, each of the coils 258 can include a number of coil layers with interspersed thermally-conductive insulation layers comprising a deposited coating or thin film. According to some embodiments, the insulation layers facilitate heat transfer between coil layers, thus enabling greater heat transfer out of each coil.

Figure 13:
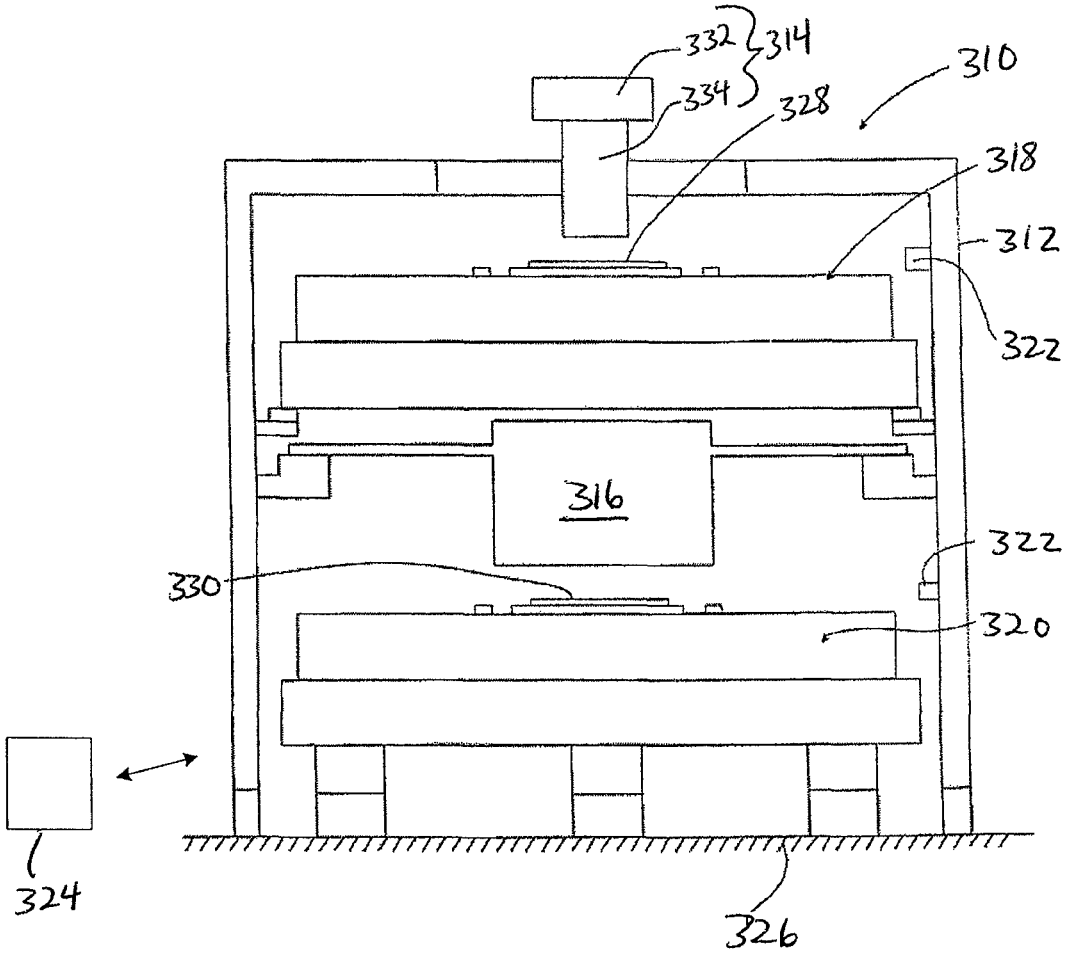
FIG. 13 is a schematic illustration of a precision stage device according to some embodiments of the invention.

FIG. 13 is a schematic illustration of a type of precision stage device, namely an exposure apparatus or lithography device 310 having features of the present invention according to some embodiments. The exposure apparatus 310 includes a frame 312, an illumination system 314 (irradiation apparatus), an optical assembly 316, a reticle stage assembly 318, a wafer stage assembly 320, a measurement system 322, and a control system 324. The exposure apparatus 310 mounts to a mounting base 326, e.g., the ground, a base, or floor or some other supporting structure. The design of the components of the exposure apparatus 310 can be varied to suit the design requirements of a particular implementation of the exposure apparatus 310. According to some embodiments of the invention, one or both of the stage assemblies 318, 320 are positioned by electric motors incorporating one or more thermally conductive coils, such as those described above.

The exposure apparatus 310 is particularly useful as a lithographic device for semiconductor manufacturing. There are a number of different types of such lithographic devices. For example, the exposure apparatus 310 can be used as a scanning type photolithography system that exposes a pattern from a reticle 328 onto a wafer 330 with the reticle 328 and the wafer 330 moving synchronously. In a scanning type lithographic device, the reticle 328 is moved perpendicularly to an optical axis of the optical assembly 316 by the reticle stage assembly 318 and the wafer 330 is moved perpendicularly to the optical axis of the optical assembly 316 by the wafer stage assembly 320. Scanning of the reticle 328 and the wafer 330 occurs while the reticle 328 and the wafer 330 are moving synchronously.

Alternatively, the exposure apparatus 310 can be a step-and-repeat type photolithography system that exposes the reticle 328 while the reticle 328 and the wafer 330 are stationary. In the step and repeat process, the wafer 330 is in a constant position relative to the reticle 328 and the optical assembly 316 during the exposure of an individual field. Subsequently, between consecutive exposure steps, the wafer 330 is consecutively moved with the wafer stage assembly 320 perpendicularly to the optical axis of the optical assembly 316 so that the next field of the wafer 330 is brought into position relative to the optical assembly 316 and the reticle 328 for exposure. Following this process, the images on the reticle 328 are sequentially exposed onto the fields of the wafer 330, and then the next field of the wafer 330 is brought into position relative to the optical assembly 316 and the reticle 328.

Of course, the use of the exposure apparatus 310 provided herein is not limited to a photolithography system for semiconductor manufacturing. The exposure apparatus 310, for example, can be used as an LCD photolithography system that exposes a liquid crystal display device pattern onto a rectangular glass plate or a photolithography system for manufacturing a thin film magnetic head. Further, the present invention can also be applied to a proximity photolithography system that exposes a mask pattern from a mask to a substrate with the mask located close to the substrate without the use of a lens assembly. In addition, the exposure apparatus 310 is merely one example of a precision stage device. In some embodiments, features of the invention may be useful for any type of precision stage device requiring high precision and accuracy in stage movement.

Referring again to FIG. 13, the apparatus frame 312 is rigid and supports the components of the exposure apparatus 310. The apparatus frame 312 supports the reticle stage assembly 318, the optical assembly 316 and the illumination system 314 above the mounting base 326.

The illumination system 314 includes an illumination source 332 and an illumination optical assembly 334. The illumination source 332 emits a beam (irradiation) of light energy. The illumination optical assembly 334 guides the beam of light energy from the illumination source 332 to the optical assembly 316. The beam selectively illuminates different portions of the reticle 328 to expose the wafer 330. In FIG. 13, the illumination source 332 is illustrated as being supported above the reticle stage assembly 318. The illumination source 332 may, however, be secured to one of the sides of the apparatus frame 312 with the energy beam from the illumination source 332 directed to above the reticle stage assembly 318 with the illumination optical assembly 334.

The illumination source 332 can be a g-line source (436 nm), an i-line source (365 nm), a KrF excimer laser (248 nm), an ArF excimer laser (193 nm) or a $F_2$ laser (157 nm). Alternatively, the illumination source 332 can generate charged particle beams such as an x-ray or an electron beam. For instance, in the case where an electron beam is used, thermionic emission type lanthanum hexaboride ($LaB_6$) or tantalum (Ta) can be used as a cathode for an electron gun. Furthermore, in the case where an electron beam is used, the structure could be such that either a mask is used or a pattern can be directly formed on a substrate without the use of a mask.

The optical assembly 316 projects and/or focuses the light passing through the reticle 328 to the wafer 330. Depending upon the design of the exposure apparatus 310, the optical assembly 316 can magnify or reduce the image illuminated on the reticle 328. The optical assembly 316 need not be limited to a reduction system, but could also be a 1× or magnification system.

When far ultra-violet rays such as the excimer laser is used, glass materials such as quartz and fluorite that transmit far ultra-violet rays can be used in the optical assembly 316. When the $F_2$ type laser or x-ray is used, the optical assembly 316 can be either catadioptric or refractive (a reticle should also preferably be a reflective type), and when an electron beam is used, electron optics can consist of electron lenses and deflectors. The optical path for the electron beams should be in a vacuum.

Also, with an exposure apparatus that employs vacuum ultra-violet radiation (VUV) of wavelength 200 nm or lower, use of a catadioptric type optical system incorporating, for example, a beam splitter and concave mirror can be considered. The exposure apparatus may also use a reflecting-refracting type of optical system incorporating a concave mirror, etc., but without a beam splitter.

According to some embodiments, the measurement system 322 monitors the actual position and movement of the reticle 328 and the wafer 330 relative to the optical assembly 316 or some other reference. For example, the measurement system 322 can utilize multiple laser interferometers, encoders, and/or other measuring devices to determine the actual position of the one or more stages in the reticle stage assembly 318 and/or the wafer stage assembly 320. This information is communicated to the control system 324, which is coupled between the reticle stage assembly 318, the wafer stage assembly 320, and the measurement system 322. The control system 324 includes one or more processing modules (implemented in, e.g., hardware, firmware, or software) which process the position information in order to control the reticle stage assembly 318 to precisely position the reticle 328 and the wafer stage assembly 320 to precisely position the wafer 330.

The reticle stage assembly 318 includes one or more reticle stages and stage motors that hold and position the reticle 328 relative to the optical assembly 316 and the wafer 330. Somewhat similarly, the wafer stage assembly 320 includes one or more wafer stages and stage motors that retain and move the wafer 330 with respect to the projected image of the illuminated portions of the reticle 328.

The design of each stage motor can be varied to suit the movement requirements of the stage assemblies 318, 320. For example, when linear motors (see, for example, U.S. Pat. Nos. 5,623,853 and 5,528,118, both of which are herein incorporated by reference) are used to move a wafer stage or a reticle stage in photolithography systems, the linear motors can be an air levitation type employing air bearings or a magnetic levitation type using Lorentz force or reactance force. As discussed with reference to FIGS. 11A-11B, the linear motors can incorporate several advantages of the present invention, such as, for example, one or more thermally conductive coils as described above.

In alternative embodiments, one of the stages could be driven by a motor assembly including one or more planar motors. Planar motors typically drive the stage by an electromagnetic force generated by a magnet unit having two-dimensionally arranged magnets and an armature coil unit having two-dimensionally arranged coils in facing positions. With this type of driving system, either the magnet unit or the armature coil unit is connected to the stage and the other unit is mounted on the moving plane side of the stage. As described with reference to FIG. 12, embodiments of the invention can advantageously include a planar motor incorporating one or more thermally conductive coils as described above. Alternatively, one or more of the motors can be another type of motor, such as a rotary motor, a voice coil motor, or some other electromagnetic motor incorporating one or more thermally conductive coils.

A photolithography system (e.g., an exposure apparatus or stage device) according to the embodiments described herein can be built by assembling various subsystems, including each element listed in the appended claims, in such a manner that prescribed mechanical accuracy, electrical accuracy, and optical accuracy are maintained. In order to maintain the various accuracies, prior to and following assembly, every optical system is adjusted to achieve its optical accuracy. Similarly, every mechanical system and every electrical system are adjusted to achieve their respective mechanical and electrical accuracies. The process of assembling each subsystem into a photolithography system includes mechanical interfaces, electrical circuit wiring connections and air pressure plumbing connections between each subsystem. Needless to say, there is also a process where each subsystem is assembled prior to assembling a photolithography system from the various subsystems. Once a photolithography system is assembled using the various subsystems, a total adjustment is performed to make sure that accuracy is maintained in the complete photolithography system. Additionally, it is desirable to manufacture an exposure system in a clean room where the temperature and cleanliness are controlled.

Figure 14:
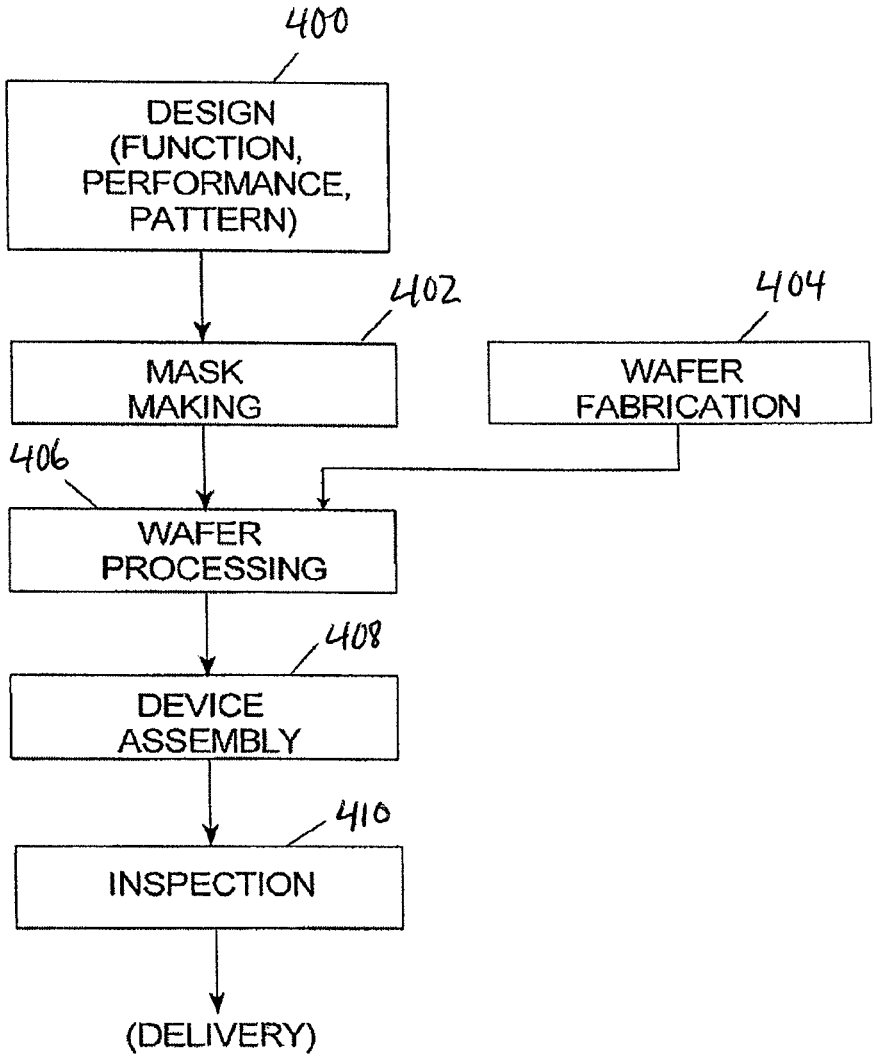
FIG. 14 is a process flow diagram illustrating a method of fabricating a semiconductor device according to some embodiments of the invention.

Further, micro-devices, e.g., semiconductor devices, may be fabricated using systems described above, as will be discussed with reference to FIG. 14. The process begins at step 400 in which the function and performance characteristics of a semiconductor device are designed or otherwise determined. Next, in step 402, a reticle (i.e., mask) having a pattern is designed based upon the design of the semiconductor device. It should be appreciated that in a parallel step 404, a wafer is made from a silicon material. The mask pattern designed in step 402 is exposed onto the wafer fabricated in step 404 in step 406 by a photolithography system that can include a coarse reticle scanning stage and a fine reticle scanning stage. One process of exposing a mask pattern onto a wafer will be described below with respect to FIG. 15. In step 408, the semiconductor device is assembled. The assembly of the semiconductor device generally includes, but is not limited to, wafer dicing, bonding, and packaging processes. Finally, the completed device is inspected in step 410 and delivered.

Figure 15:
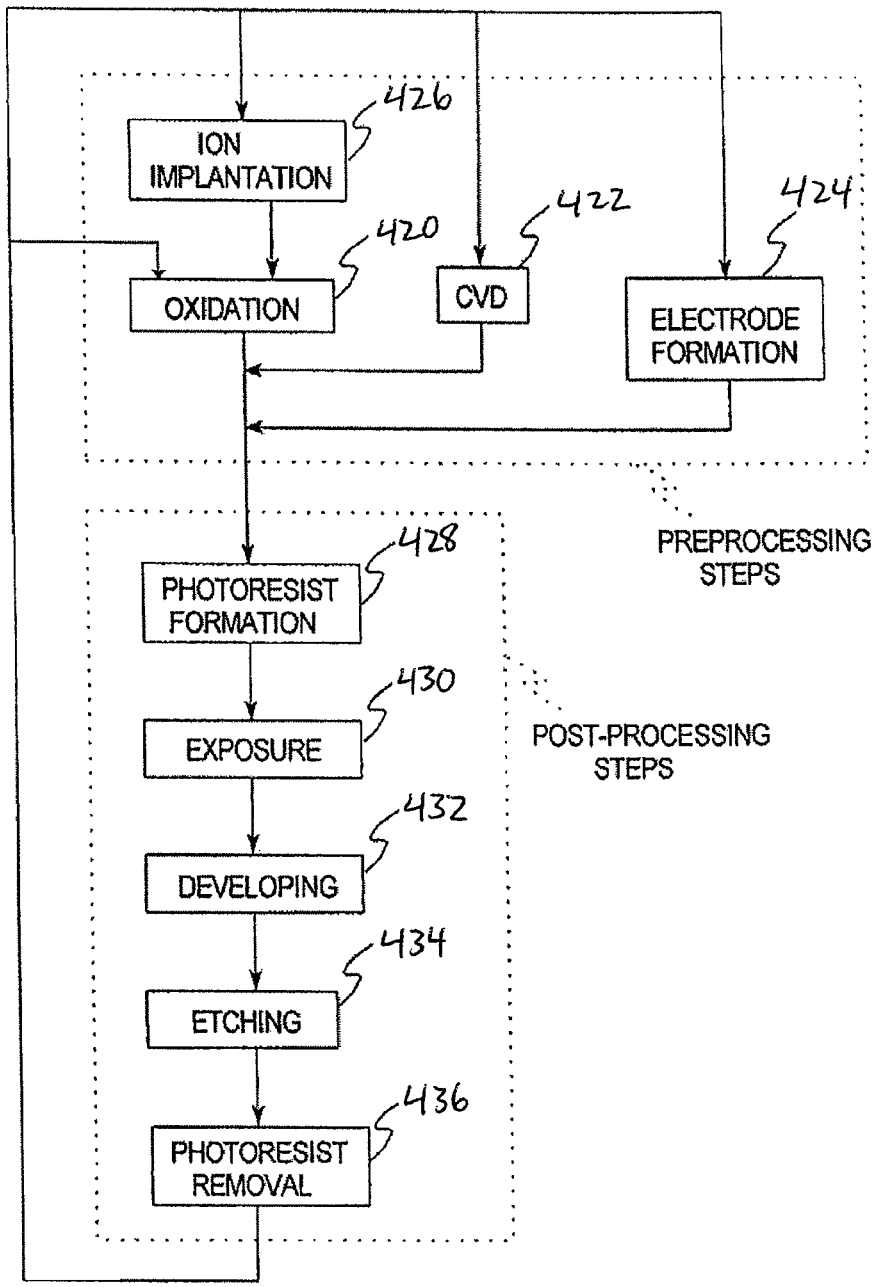
FIG. 15 is a process flow diagram illustrating in detail the method of wafer processing of FIG. 14.

FIG. 15 is a process flow diagram which illustrates the steps associated with wafer processing in the case of fabricating semiconductor devices in accordance with an embodiment of the present invention. In step 420, the surface of a wafer is oxidized. Then, in step 422 which is a chemical vapor deposition (CVD) step, an insulation film may be formed on the wafer surface. Once the insulation film is formed, in step 424, electrodes are formed on the wafer by vapor deposition. Then, ions may be implanted in the wafer using substantially any suitable method in step 426. As will be appreciated by those skilled in the art, steps 420-426 are generally considered to be preprocessing steps for wafers during wafer processing. Further, it should be understood that selections made in each step, e.g., the concentration of various chemicals to use in forming an insulation film in step 422, may be made based upon processing requirements.

At each stage of wafer processing, when preprocessing steps have been completed, post-processing steps may be implemented. During post-processing, initially, in step 428, photoresist is applied to a wafer. Then, in step 430, an exposure apparatus such as one having one or more exemplary systems described herein may be used to transfer the circuit pattern of a reticle to a wafer.

After the circuit pattern on a reticle is transferred to a wafer, the exposed wafer is developed in step 432. Once the exposed wafer is developed, parts other than residual photoresist, e.g., the exposed material surface, may be removed by an etching step 434. Finally, in step 436, any unnecessary photoresist that remains after etching may be removed. As will be appreciated by those skilled in the art, multiple circuit patterns may be formed through the repetition of the preprocessing and post-processing steps.

Thus, embodiments of the THERMALLY CONDUCTIVE COIL, METHODS AND SYSTEMS are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention and the scope of the appended claims.

What is claimed is:

1. A thermally conductive electromagnetic coil, the coil comprising:

a first coil layer comprising windings of a first wire, the first wire including a conductor and an insulator electrically insulating windings of the conductor within the first coil layer, wherein the windings of the first wire define outer first and second surfaces of the first coil layer, and wherein the insulator of the first wire is at least partially absent along the first surface of the first coil layer; and a second coil layer comprising windings of a second wire, the second wire including a conductor and an insulator electrically insulating windings of the conductor within the second coil layer, wherein the windings of the second wire define outer first and second surfaces of the second coil layer, wherein the first and second coil layers are positioned with the second surface of the second coil layer facing the first surface of the first coil layer, and wherein the insulator of the second wire is at least partially absent along the second surface of the second coil layer.

2. The coil of claim 1, further comprising a first insulation layer between the first and second coil layers electrically insulating the first surface of the first coil layer from the second surface of the second coil layer.

3. The coil of claim 1, wherein the first surface of the first coil layer is a machined surface and the second surface of the second coil layer is a machined surface.

4. The coil of claim 2, wherein each of the first insulation layer, the insulator of the first wire, and the insulator of the second wire comprise the same material.

5. The coil of claim 2, wherein the first insulation layer has a thermal conductivity greater than thermal conductivities of the insulator of the first wire and the insulator of the second wire.

6. The coil of claim 5, wherein the thermal conductivity of the first insulation layer is more than about 10 times greater than the thermal conductivities of the insulator of the first wire and the insulator of the second wire.

7. The coil of claim 5, wherein the first insulation layer comprises a ceramic material.

8. The coil of claim 5, wherein the first insulation layer comprises a material selected from the group consisting of aluminum nitride, beryllium oxide, silicon, and diamond.

9. The coil of claim 2, wherein the first insulation layer comprises an insulating sheet.

10. The coil of claim 2, wherein the first insulation layer comprises a coating on the first surface of the first coil layer.

11. The coil of claim 10, wherein the coating is a thin film deposited onto the first surface of the first coil layer.

12. The coil of claim 10, further comprising a second insulation layer comprising a coating on the second surface of the second coil layer.

13. A coil assembly for an electromagnetic device, the coil assembly comprising the coil of claim 1, a compartment enclosing the coil, and a coolant within the compartment for transferring heat from the coil, wherein the second surface of the first coil layer is an exterior coil surface in contact with the coolant and wherein the insulator of the first wire is at least partially absent along the second surface of the first coil layer for providing heat transfer between the first coil layer and the coolant.

14. A linear or planar motor comprising a magnet assembly and the coil of claim 1.

15. An exposure apparatus comprising a first stage, a second stage, and the linear or planar motor of claim 14 coupled to one of the first and second stages for moving the one of the first and second stages relative to the other one of the first and second stages.

16. A thermally conductive electromagnetic coil, the coil comprising:

a plurality of coil layers arranged around a common coil axis, each coil layer comprising windings of a wire including a conductor and a wire insulator, the windings providing each respective coil layer with a generally planar configuration and outer surfaces extending perpendicularly with respect to the common coil axis; and a generally planar first insulation layer between each of the plurality of coil layers, wherein the first insulation layer provides a thermal interface between opposing outer surfaces of adjacent coil layers, and wherein the wire insulators of the adjacent coil layers are at least partially removed along the opposing outer surfaces of each of the adjacent coil layers.

17. The coil of claim 16, wherein the first insulation layer has a thermal conductivity greater than thermal conductivities of the wire insulators of the plurality of coil layers.

18. The coil of claim 17, wherein the first insulation layer comprises a material selected from the group consisting of aluminum nitride, beryllium oxide, silicon, and diamond.

19. The coil of claim 16, wherein the first insulation layer comprises an insulating sheet.

20. The coil of claim 16, wherein the first insulation layer comprises a coating on one of the opposing outer surfaces of the adjacent coil layers.

21. The coil of claim 20, further comprising a generally planar second insulation layer comprising a coating on the other of the opposing outer surfaces of the adjacent coil layers.

22. A linear or planar motor comprising a magnet assembly and a plurality of coils according to claim 16.

23. A thermally conductive electromagnetic coil, the coil comprising:

a first coil layer comprising windings of a first wire, the first wire including first conducting means for conducting an electrical current and first insulating means for electrically insulating consecutive windings of the first wire within the first coil layer, wherein the windings of the first wire define outer first and second surfaces of the first coil layer, wherein the first insulating means comprises an electrically insulating material extending between consecutive windings of the first wire but not onto the first surface of the first coil layer;

a second coil layer comprising windings of a second wire, the second wire including second conducting means for conducting an electrical current and second insulating means for electrically insulating consecutive windings of the second wire within the second coil layer, wherein the windings of the second wire define outer first and second surfaces of the second coil layer; and third insulating means between the first and second coil layers for electrically insulating the first and second coil layers and for providing a thermal interface between the first and second coil layers.

24. The coil of claim 23, wherein the third insulating means has a greater thermal conductivity than either the first insulating means or the second insulating means.

* * * * *